US008297562B1

(12) United States Patent
Yeates et al.

(10) Patent No.: US 8,297,562 B1
(45) Date of Patent: Oct. 30, 2012

(54) UNIVERSAL MOUNTING PLATFORM

(75) Inventors: Eric M. Yeates, Virginia Beach, VA (US); Birten L. Todd, Harrison, MT (US); Thomas M. Gregory, Belgrade, MT (US); Robert A. Kincaid, Bozeman, MT (US); Clifton L. Cook, Boise, ID (US); Thomas A. Marx, Virginia Beach, VA (US)

(73) Assignee: Alliant Techsystems Inc., Minneapolis, MN (US)

( * ) Notice: Subject to any disclaimer, the term of this patent is extended or adjusted under 35 U.S.C. 154(b) by 1427 days.

(21) Appl. No.: 11/906,629

(22) Filed: Oct. 3, 2007

Related U.S. Application Data

(60) Provisional application No. 60/849,318, filed on Oct. 3, 2006.

(51) Int. Cl.
*B43L 15/00* (2006.01)

(52) U.S. Cl. ..... 248/118.3; 248/689; 248/222.51; 224/191; 224/238

(58) Field of Classification Search ..... 248/118, 248/118.3, 688–691, 222.51, 222.52; 224/191–193, 224/198, 238, 243, 587, 901.4, 911, 912
See application file for complete search history.

(56) References Cited

U.S. PATENT DOCUMENTS

| | | | | |
|---|---|---|---|---|
| 3,731,858 | A * | 5/1973 | Baker | 224/192 |
| 4,544,089 | A * | 10/1985 | Tabler | 224/192 |
| 4,809,895 | A * | 3/1989 | Peltier | 224/674 |
| 5,419,472 | A * | 5/1995 | Hellweg et al. | 224/198 |
| 5,544,794 | A * | 8/1996 | Nichols | 224/667 |
| 6,575,343 | B2 * | 6/2003 | Mossman | 224/198 |
| 7,314,152 | B1 * | 1/2008 | Garrett | 224/192 |
| 7,320,420 | B2 * | 1/2008 | Buis et al. | 224/197 |
| 7,331,872 | B1 * | 2/2008 | Parsons | 463/47.2 |
| 7,556,181 | B2 * | 7/2009 | Spielberger | 224/244 |
| 7,866,515 | B1 * | 1/2011 | Buis et al. | 224/197 |
| 2005/0205621 | A1 * | 9/2005 | Shults | 224/198 |
| 2007/0095869 | A1 * | 5/2007 | Gallagher | 224/192 |
| 2008/0073393 | A1 * | 3/2008 | Soderquist et al. | 224/243 |
| 2008/0142556 | A1 * | 6/2008 | Fan | 224/243 |
| 2009/0001117 | A1 * | 1/2009 | Rassias | 224/673 |
| 2009/0277936 | A1 * | 11/2009 | Rogers et al. | 224/191 |
| 2012/0175391 | A1 * | 7/2012 | Rogers et al. | 224/182 |

* cited by examiner

*Primary Examiner* — Terrell McKinnon
*Assistant Examiner* — Monica Millner
(74) *Attorney, Agent, or Firm* — Wooten & Shaddock, PLC

(57) ABSTRACT

A mounting platform for removable attachment between tunnel segments of parallel webbing, including at least one accessory attachment portion; at least one primary coupling portion extending from the accessory attachment portion; a hook extending from a portion of the primary coupling portion, wherein the hook allows the primary coupling portion of the primary coupling portion to be removably secured to a portion of webbing when the primary coupling portion has been positioned within a tunnel segment of the parallel webbing.

23 Claims, 7 Drawing Sheets

UNIVERSAL MOUNTING PLATFORM

CROSS-REFERENCE TO RELATED APPLICATIONS

This nonprovisional patent application claims the benefit of U.S. Provisional Patent Application Ser. No. 60/849,318, filed Oct. 3, 2006, the disclosure of which is incorporated herein by reference.

BACKGROUND OF THE INVENTION

1. Field of the Invention

This invention relates generally to mounting platforms or panels. In particular, the present invention relates to a S.T.R.I.K.E. compatible mounting platform or panel upon which a holster and/or optional accessories may be attached.

2. Description of Related Art

Military and law enforcement personnel, particularly those attached to special operations unit, carry a large amount of specially designed and adapted gear. Because of the constantly changing landscape of the modern battlefield, and the rapidly changing mission of law enforcement, it is advantageous for operators to be able to configure and/or reconfigure pouches, pockets, holsters, holders, and other accessories on vests, body armor, packs, platforms, and other carriers.

The interchangeability of pouches, pockets, and accessories is of particular importance because it allows, for example, a single load-bearing vest to be reconfigured to meet certain mission specific needs.

The terms MOLLE (Modular Lightweight Load-carrying Equipment) or S.T.R.I.K.E. (Soldier Tactical Retro Integrated Kit Enhanced) are used to generically describe load bearing systems and subsystems that utilize corresponding rows of woven webbing for modular pouch, pocket, and accessory attachment. Generally, the terms MOLLE and S.T.R.I.K.E. are interchangeable.

The S.T.R.I.K.E. system is a modular system that incorporates the use of corresponding rows of webbing stitched onto a piece of equipment, such as a vest, and the various S.T.R.I.K.E. compatible pouches, pockets, and accessories, each accessory having mating rows of stitched webbing. S.T.R.I.K.E. compatible pouches, pockets, and accessories of various utility can then be attached wherever S.T.R.I.K.E. webbing exists on the equipment.

An exemplary S.T.R.I.K.E. compatible carrier includes a plurality of substantially parallel, spaced apart carrier webbings. Each of the carrier webbings is secured to the carrier at spaced apart locations, such that a tunnel segment is formed between the carrier and the carrier webbing between each secured location of the carrier webbing. Each of the tunnel segments is formed substantially perpendicular to a longitudinal direction of the carrier webbing.

Similarly, an exemplary accessory includes a plurality of substantially parallel, spaced apart accessory webbings. The accessory webbings are spaced apart so as to correspond to the spaces between the spaced apart carrier webbings. The accessory webbings are secured to the accessory at spaced apart locations, such that an accessory tunnel segment is formed between the accessory and the accessory webbing between each secured location of the accessory webbing. Each of the accessory tunnel segments is formed substantially perpendicular to a longitudinal direction of the accessory webbing.

When the accessory is placed adjacent the carrier such that the accessory webbings are within the spaces between the spaced apart carrier webbings (and the carrier webbings are within the spaces between the spaced apart accessory webbings) and corresponding tunnel segments and accessory tunnel segments are aligned, a coupling member may be interwoven between the aligned tunnel segments and accessory tunnel segments to removably attach the accessory to the carrier.

Thus, through the use of a S.T.R.I.K.E.-type system, a given accessory may be mounted to a variety of carriers. Likewise, if a particular carrier includes a S.T.R.I.K.E. compatible system, a variety of accessories may be interchangeably mounted to the platform to accommodate a variety of mission load-outs.

S.T.R.I.K.E. compatible systems allow an operator to specifically tailor a load to an individual mission and then reconfigure the equipment to meet changing or dissimilar operational requirements. Mission essential pouches, pockets, and accessories can be added and unnecessary pouches, pockets, or accessories can be removed.

SUMMARY OF THE INVENTION

This invention relates generally to a S.T.R.I.K.E. compatible mounting platform or panel upon which a holster and/or optional accessories or accessory rails may be attached or included as part of the platform itself. The mounting platform of this invention, while being simple to adjust, easy to maintain, and cost effective to produce, provides a user with an ability to readily secure a platform to a portion of MOLLE or S.T.R.I.K.E. webbing and easily position a handgun holster or other optional accessory at a desired angle on the platform.

In various exemplary, non-limiting embodiments, the platform comprises at least one accessory attachment portion and at least one primary coupling member. The at least one primary coupling member comprises an elongate portion of material that extends from the accessory attachment portion. The at least one primary coupling member includes at least one hook or catch formed proximate an end portion of the at least one primary coupling member. The hook or catch allows the at least one primary coupling member to be removably secured to a carrier webbing when the at least one primary coupling member has been positioned or interwoven between one or more tunnel segments. Thus, the hook allows the at least one primary coupling member, and, ultimately the accessory attachment portion of the panel, to be secured to a portion of S.T.R.I.K.E. webbing.

In various exemplary, non-limiting embodiments, the platform comprises a pair of primary coupling members and a pair of secondary coupling members that extend from the accessory attachment portion. The included primary and secondary coupling members allow the platform to be removably secured to a portion of S.T.R.I.K.E. webbing.

In various exemplary, non-limiting embodiments, the platform may comprise any number and combination of primary and/or secondary coupling members. For example, the platform may include only one primary coupling member, one primary coupling member and one secondary coupling member, one primary coupling member and two secondary coupling members, one primary coupling member and a plurality of secondary coupling members, two primary coupling members, two primary coupling members and one secondary coupling members, two primary coupling members and two secondary coupling members, one primary coupling member and a plurality of secondary coupling members, a plurality of primary coupling members, a plurality of primary coupling members and one secondary coupling member, a plurality of primary coupling members and two secondary coupling members, or a plurality of primary coupling members and a plurality of secondary coupling members.

In various exemplary embodiments, the accessory attachment portion includes a plurality of attachment or mounting points for attaching an accessory to the platform. By providing a plurality of attachment points, a wide variety of accessories may be attached to the platform. Furthermore, by changing the specific attachment points that are utilized to attach an accessory to the platform, and angle between the platform and the coupled accessory may be changed. That is to say, an angle between the holster and platform may be adjusted.

For example, a holster may be attached to the platform at one of a variety of angles, such that when the platform is secured to a portion of S.T.R.I.K.E. webbing on a vest, a holstered handgun may be presented to the user at a particular angle.

In various exemplary, non-limiting embodiments, the platform may comprise at least one substantially blank mounting portion that allows a user to create or form attachment points, via, for example, hole drilling or machining, such that the platform can be further customized by the user.

In various exemplary embodiments, the platform is substantially symmetrical about a central vertical axis, such that the platform may be secured to a portion of S.T.R.I.K.E. webbing with the at least one primary coupling member oriented in either an upward or a downward pointing direction.

Accordingly, this invention provides a S.T.R.I.K.E. compatible mounting platform of improved design.

This invention separately provides a S.T.R.I.K.E. compatible mounting platform, which is capable of allowing accessories to be removably attached to an accessory attachment portion.

This invention separately provides a S.T.R.I.K.E. compatible mounting platform, which is capable of allowing accessories to be removably attached to an accessory attachment portion at a number of angles.

This invention separately provides a mounting platform, which is capable of allowing a holster and/or accessories or accessory holsters or rails to be secured to a portion of S.T.R.I.K.E. webbing.

This invention separately provides a mounting platform, which provides increased stability.

This invention separately provides a mounting platform, which simulates the performance benefits of sewn on stability.

This invention separately provides a relatively low bulk mounting platform, which has little weight and a relatively flat profile.

This invention separately provides a platform, which provides for "quiet" adjustment of accessories.

This invention separately provides a platform, which is capable of providing enough flex to be comfortable while still eliminating the "sagging" that is commonly associated, through time, age, use, and environmental conditions with the current fabric-based webbing strap systems.

This invention separately provides a platform, which can easily be replaced, if necessary, even in the field.

This invention separately provides a platform, which is compact enough to allow a user to easily carry extra platforms.

This invention separately provides a mounting platform, which provides the user with easier access to the handgun or other accessories attached to the platform.

This invention separately provides a mounting platform, having edges and contours that can be shaped to minimize any damage to either the wearer or the attached accessory or carrier.

These and other features and advantages of this invention are described in or are apparent from the following detailed description of the exemplary embodiments.

BRIEF DESCRIPTION OF THE DRAWINGS

The exemplary embodiments of this invention will be described in detail, with reference to the following figures, wherein like reference numerals refer to like parts throughout the several views, and wherein.

DETAILED DESCRIPTION OF EXEMPLARY EMBODIMENTS

For simplicity and clarification, the design factors and operating principles of the mounting platform according to this invention are explained with reference to various exemplary embodiments of a mounting platform according to this invention. The basic explanation of the design factors and operating principles of the mounting platform is applicable for the understanding, design, and operation of the mounting platform of this invention.

Furthermore, it should be appreciated that, for simplicity and clarification, the embodiments of this invention will be described with reference to a handgun holster and/or an accessory rail being attached to or formed as a portion of the mounting platform. However, it should be appreciated that a plurality of various rigid, semi-rigid, or soft pouches, pockets, carriers, bags, holders, holsters, accessories, accessory rails, or the like may be attached to or formed as a portion of the mounting platform.

It should also be appreciated that, as used herein, the terms "MOLLE" and "S.T.R.I.K.E." are used for basic explanation and understanding of the operation of the systems, methods, and apparatuses of this invention. Therefore, the terms "MOLLE" and "S.T.R.I.K.E." are not to be construed as limiting the systems, methods, and apparatuses of this invention. Thus, the terms "MOLLE" and "S.T.R.I.K.E." are to be understood to broadly include any and all systems and subsystems that utilize spaced attachments for woven, modular pouch or accessory attachment.

As used herein, the terms "mounting platform", "platform", and "panel" are used for basic explanation and understanding of the operation of the systems, methods, and apparatuses of this invention. Therefore, the terms "mounting platform", "platform", and "panel" are not to be construed as limiting the systems, methods, and apparatuses of this invention.

Figure 1:
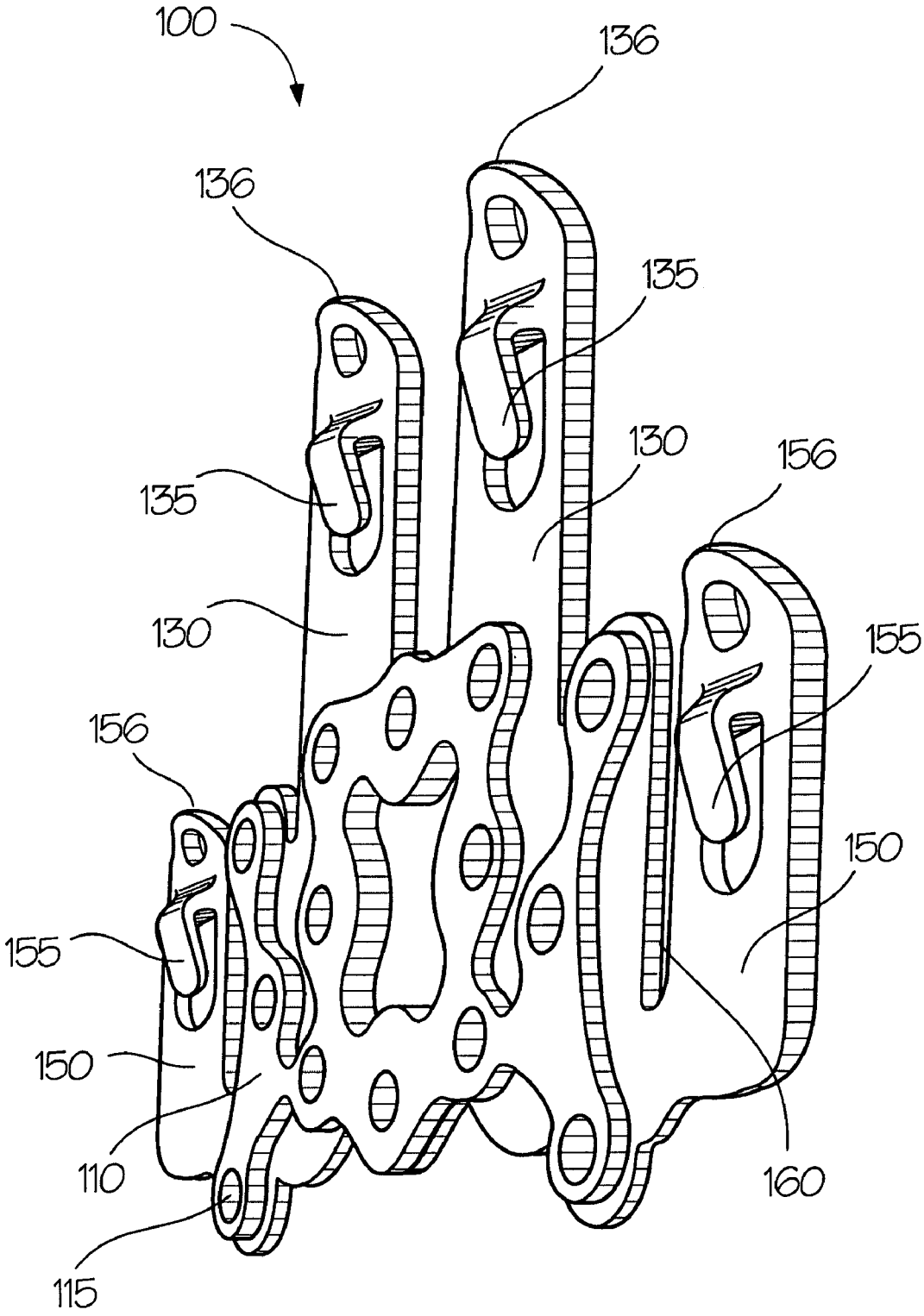
FIG. 1 shows a perspective view of a first exemplary embodiment of a mounting platform according to this invention.

Turning now to FIG. 1, FIG. 1 shows a perspective view of a first exemplary embodiment of a mounting platform 100 according to this invention. As illustrated in FIG. 1, the mounting platform 100 comprises an accessory attachment portion 110, two primary coupling portions 130, and two secondary coupling portions 150.

It should be understood that, while the platform 100 comprises one accessory attachment portion 110, two primary coupling portions 130, and two secondary coupling portions 150, the platform of this invention may comprise any number of accessory attachment portions, primary coupling portions, and/or secondary coupling portions.

Figure 2:
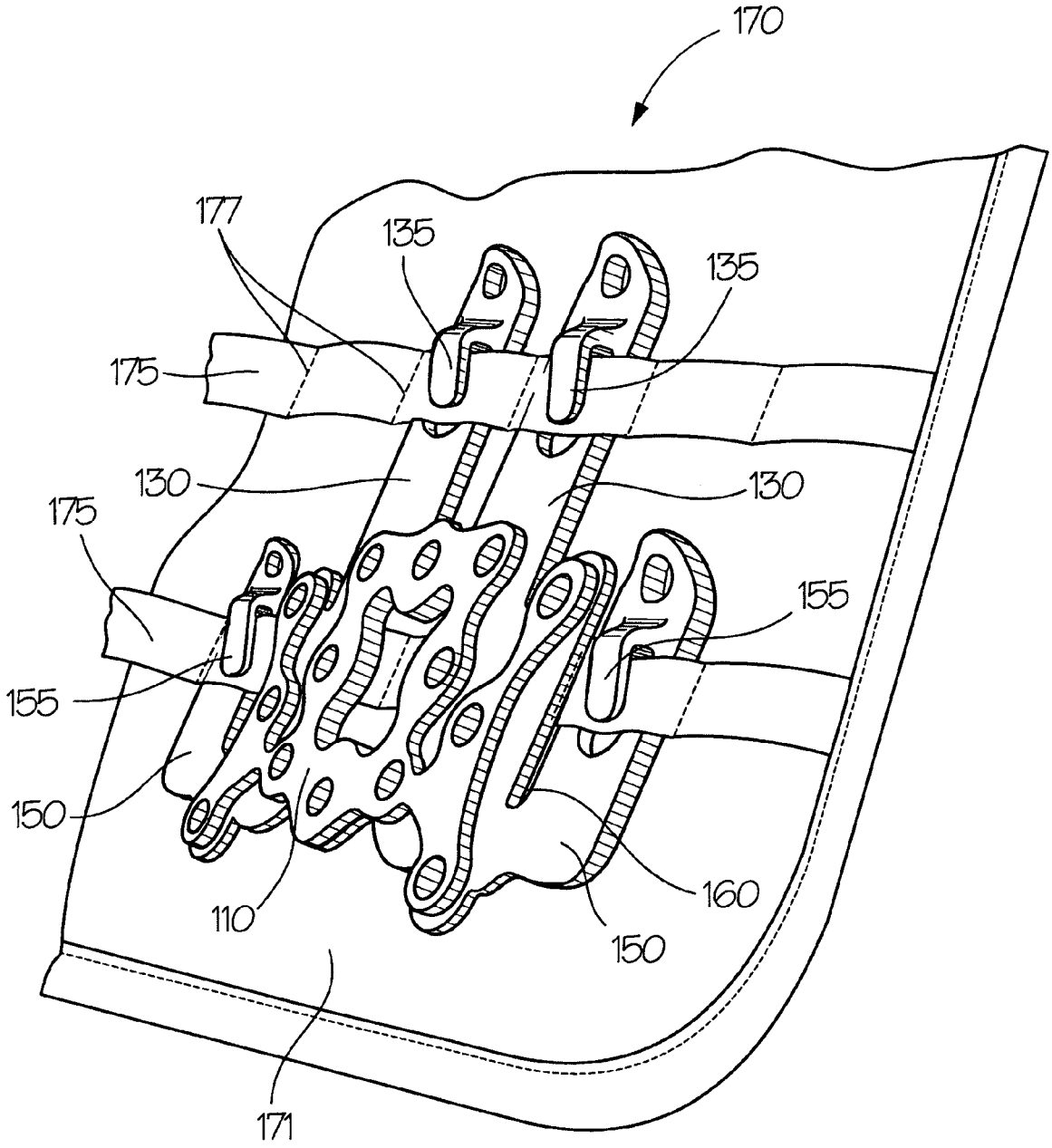
FIG. 2 shows a perspective view of a first exemplary embodiment of the mounting platform, wherein the mounting platform is secured to a portion of S.T.R.I.K.E. webbing according to this invention.
Figure 3A:
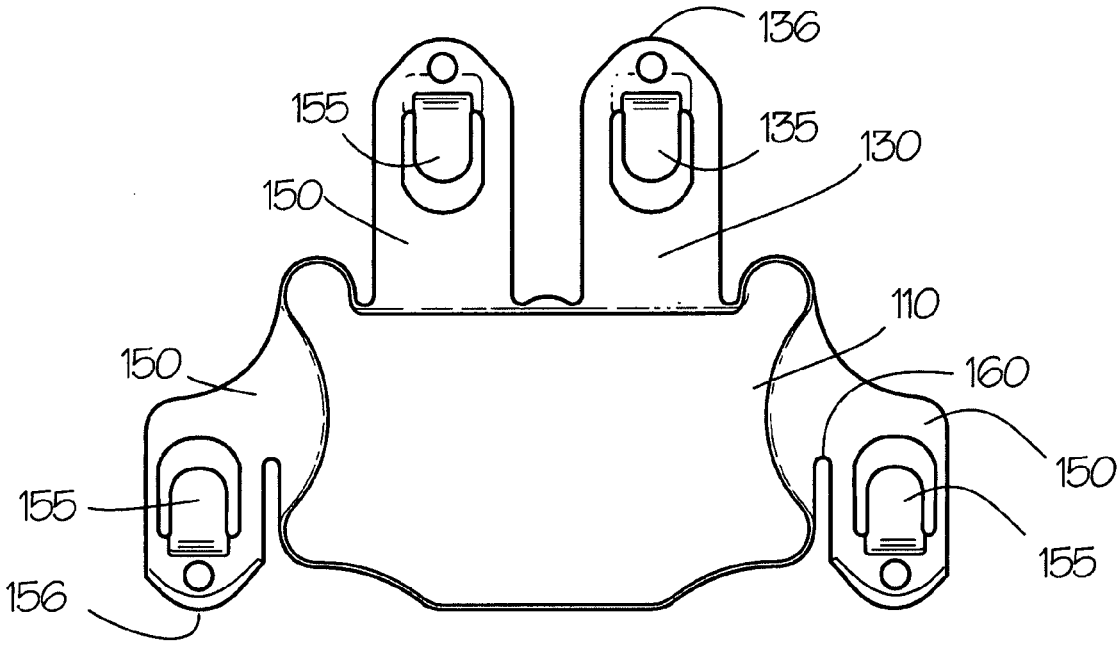
FIG. 3A shows a front view of an additional exemplary embodiment of the mounting platform, wherein an accessory attachment portion of the mounting platform comprises a substantially blank mounting portion.
Figure 3B:
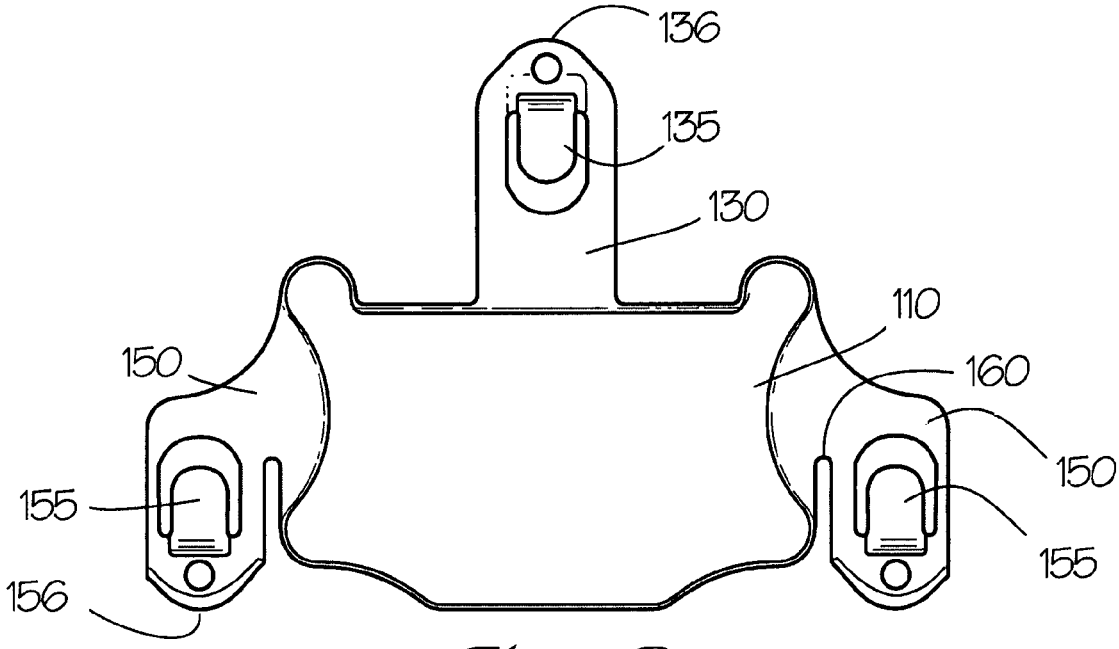
FIG. 3B shows a front view of an additional exemplary embodiment of the mounting platform, wherein the mounting platform includes only one primary coupling portion.

For example, as illustrated in FIG. 3B, the platform 100 comprises only one primary coupling portion 130. It should be appreciated that the end exemplary embodiments where in the platform 100 comprises only one primary coupling portion 130, the platform 100 has an overall size that allows the one primary coupling portion 130 to be aligned with and extend into a tunnel segment formed in the S.T.R.I.K.E. webbing 170, as discussed in greater detail with regard to FIG. 2.

It should also be appreciated that while the accessory attachment portion 110, as illustrated in FIG. 3B, does not include any attachment points, any number or type of attachment points may be included in the accessory attachment portion 110. of the platform illustrated in FIG. 3B.

As illustrated in FIG. 1, the mounting platform 100 comprises an accessory attachment portion 110, two primary coupling portions 130 extending from the accessory attachment portion 110, and two secondary coupling portion 150 extending proximate a side portion of the accessory attachment portion 110. It should be appreciated that the overall number and length of coupling portions 130 and 150 is a design choice based on the desired appearance, strength, and functionality of the mounting platform 100.

In various exemplary embodiments, the mounting platform 100 is formed of a rigid or a semi-rigid plastic or polymeric material, such as a polymeric composite. In various exemplary embodiments, the mounting platform 100 is injection-molded. Alternatively, the mounting platform 100 may be heat-formed from sheet stock, such as, for example a polymer. In still other exemplary embodiments, the mounting platform 100 may be stamped or rolled from a sheet of metal or may be formed from aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass or polymer fiber reinforced plastics, thermoform and/or thermoset sheet materials, and/or various combinations of the foregoing. It should also be appreciated that the mounting platform 100 may be formed of, over-molded, or coated by multiple materials. Thus, it should be understood that the material or materials used to form the mounting platform 100 is a design choice based on the desired appearance, strength, flexibility, and functionality of the mounting platform 100.

The edges and contours of the mounting platform 100 may be shaped to minimize any damage to the wearer of the carrier, the carrier webbings, the accessory, or the accessory webbings.

While the overall size and shape of the accessory attachment portion 110 is a design choice based on the desired appearance, strength, and functionality of the mounting platform 100, the accessory attachment portion 110 includes a plurality of attachment points 115. In various exemplary, non-limiting embodiments, the attachment points 115 comprise a plurality of holes or apertures formed in the accessory attachment portion 110. In various exemplary embodiments, the spacing and arrangement of the attachment points 115 is such that a number of varied accessories can be attached to the mounting platform 100. Furthermore, the spacing and arrangement of the attachment points 115 may allow for a single accessory to be mounted at various angles relative to the mounting platform 100.

While the attachment points 115 are illustrated as comprising holes or apertures formed in the accessory attachment portion 110, it should be appreciated that the attachment points 115 may comprise holes, apertures, threaded portions, protrusions, recesses, snaps, or any other structure capable of being used alone or in combination with other structures to attach or couple accessories to the accessory attachment portion 110.

It should also be understood that, in various exemplary, non-limiting embodiments, as illustrated in FIG. 3, the accessory attachment portion 110 may comprise at least one substantially blank mounting portion that allows a user to create or form attachment points 115, via, for example, hole drilling or machining, such that the platform 100 can be further customized by the user.

As further illustrated in FIG. 1, two primary coupling portions 130 extend upward from a top portion of the accessory attachment portion 110 of the mounting platform 100. The two, substantially parallel, spaced apart, primary coupling portions 130 are formed at a distance that allows the primary coupling portions 130 to each extend into a tunnel segment formed in the S.T.R.I.K.E. webbing 170, as discussed in greater detail with regard to FIG. 2.

The primary coupling portions 130 each include a hook 135 formed in a portion of the primary coupling portion 130. The hook 135 allows the mounting platform 100 to be removably secured to a portion of S.T.R.I.K.E. webbing 170, when the primary coupling portions 130 have been positioned or interwoven between one or more tunnel segments of parallel webbing 175, as discussed in greater detail with regard to FIG. 2.

Likewise, two secondary coupling portions 150 extend from the accessory attachment portion 110 of the mounting platform 100. The two, substantially parallel, spaced apart, secondary coupling portions 150 are each formed in part by two grooves 160 formed in the sides of the accessory attachment portion 110. The grooves 160 are formed at a distance that allows the secondary coupling portions 150 to each extend into a tunnel segment formed in the S.T.R.I.K.E. webbing 170, as discussed in greater detail with regard to FIG. 2.

The secondary coupling portions 150 each includes a hook 155 formed in a portion of the secondary coupling portion 150. The hook 155 allows the mounting platform 100 to be removably secured to a portion of S.T.R.I.K.E. webbing 170, when the mounting platform 100 has been positioned or interwoven between one or more tunnel segments of parallel webbing 175, as discussed in greater detail with regard to FIG. 2.

Furthermore, as illustrated in FIG. 1, a portion of the primary coupling portions 130 and/or the secondary coupling portions 150 may optionally include a curved portion 136 and/or 156, respectively. Alternatively, an end portion of the primary coupling portions 130 and/or the secondary coupling portions 150 may terminate in a relatively planar end portion.

FIG. 2 shows a perspective view of a first exemplary embodiment of the mounting platform 100, wherein the mounting platform 100 is secured to an exemplary portion of S.T.R.I.K.E. webbing 170 according to this invention. As shown in FIG. 2, the exemplary portion of S.T.R.I.K.E. webbing 170 includes a plurality of parallel webbings 175. Each of the parallel webbings 175 is secured to a carrier material 171 at spaced apart locations 177, such that a tunnel segment is formed between the parallel webbings 175 and the carrier material 171 between each secured locations 177. Each of the tunnel segments is formed substantially perpendicular to a longitudinal direction of the parallel webbing 175.

As discussed above, the primary coupling portions 130 and the secondary coupling portions 150 are each spaced apart so as to correspond to tunnel segments of parallel webbing 175.

Thus, the mounting platform 100 may be secured to the portion of S.T.R.I.K.E. webbing 170 by aligning the primary coupling portions 130 and the secondary coupling portions 150 with a corresponding tunnel segment of parallel webbing 175. Once aligned, the primary coupling portions 130 and the secondary coupling portions 150 are slid into the corresponding tunnel segment of parallel webbing 175 until the hooks 135 and 155 are able to be removably secured to a portion of the parallel webbing 175. When the hooks 135 and 155 are removably secured to a portion of the parallel webbing 175, the mounting platform 100 is drawn towards and removably attached to the S.T.R.I.K.E. webbing 170.

It should be appreciated at any accessories that are to be attached or coupled to the mounting platform 100 are typically attached or coupled to the mounting platform 100 prior to the mounting platform 100 being secured to a portion of S.T.R.I.K.E. webbing.

Figure 4A:
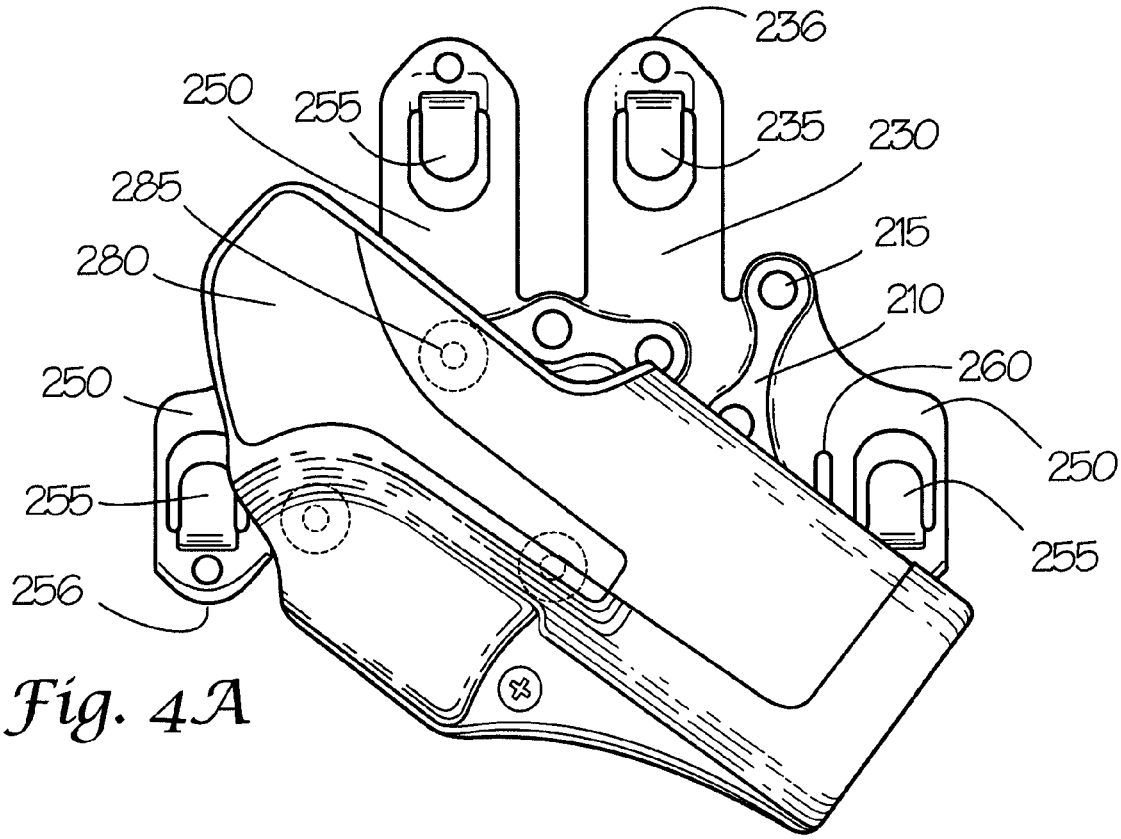
FIG. 4A shows a front view of a second exemplary embodiment of the mounting platform, wherein an exemplary holster is attached to the platform according to this invention.
Figure 4B:
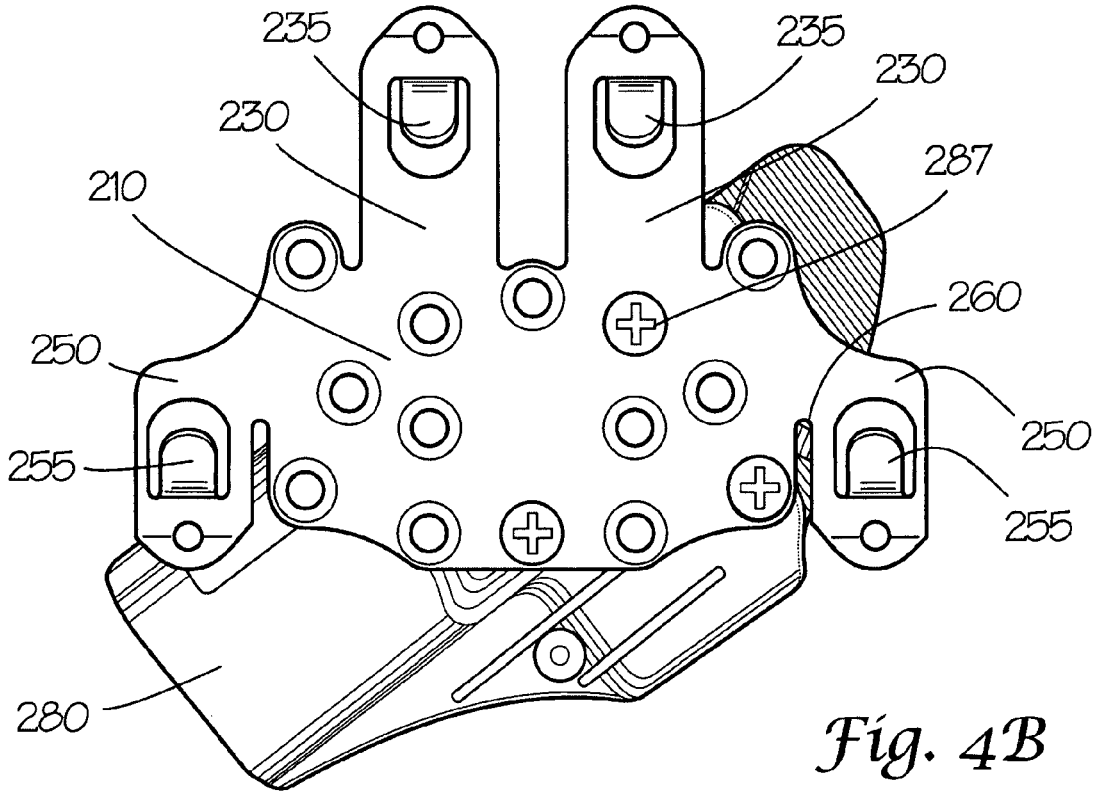
FIG. 4B shows a rear view of a second exemplary embodiment of the mounting platform, wherein an exemplary holster is attached to the platform according to this invention.

FIGS. 4A and 4B show a front view and a rear view, respectively, of a second exemplary embodiment of a mounting platform, wherein an exemplary holster is attached to the mounting platform 200, according to this invention. As illustrated in FIGS. 4A and 4B, the mounting platform 200 comprises at least some of a plurality of attachment points 215 defining an accessory attachment portion 210, two primary coupling portions 230, each including a hook 235 and extending from the accessory attachment portion 210, two secondary coupling portion 250, each including a hook 255 and extending from the accessory attachment portion 210, and grooves 260.

It should be understood that each of these elements corresponds to and operates similarly to the accessory attachment portion 110, the plurality of attachment points 115, primary coupling portion(s) 130, the hook(s) 135, the secondary coupling portion(s) 150, the hook(s) 155, and the grooves 160, as described above with reference to the mounting platform 100 of FIGS. 1 and 2.

However, as shown in FIGS. 1 and 2, the primary coupling portion(s) 130 and the secondary coupling portion(s) 150 extend upward from the accessory attachment portion 110. In contrast, in FIG. 3, the primary coupling portion(s) 130 extend upward from the accessory attachment portion 110 while the secondary coupling portion(s) 150 extend downward from the accessory attachment portion 110. It should be appreciated that the relative orientation of each of the primary coupling portion(s) 130 and the secondary coupling portion(s) 150, is a design choice based on the desired appearance, strength, functionality, and compatibility of the mounting platform.

Additionally, as shown in FIGS. 1 and 2, the hooks 135 and the hooks 155 are oriented in the same direction. In contrast, in FIG. 3, the hooks 235 and the hooks 255 are oriented in opposite directions. It should be appreciated that the orientation (i.e., orientation in similar or opposing directions as well as the hook protruding either towards or away from the individual mounting surfaces of either the carrier or an accessory) of each of the hooks 135, 155, 235, and 255, is a design choice based on the desired appearance, strength, functionality, and compatibility of the mounting platform.

As illustrated in FIGS. 4A and 4B, a holster 280 is attached to the accessory attachment portion 210, via three fastening means 287, such as, for example, screws, being placed through three of the attachment points 215 and engaging three attachment points 285 of the holster 280. It should be appreciated that by aligning the three attachment points 285 of the holster 280 with various attachment points 215, the holster 280 may be attached or coupled to the mounting platform 200 at various angles relative to the mounting platform 200.

Figure 5A:
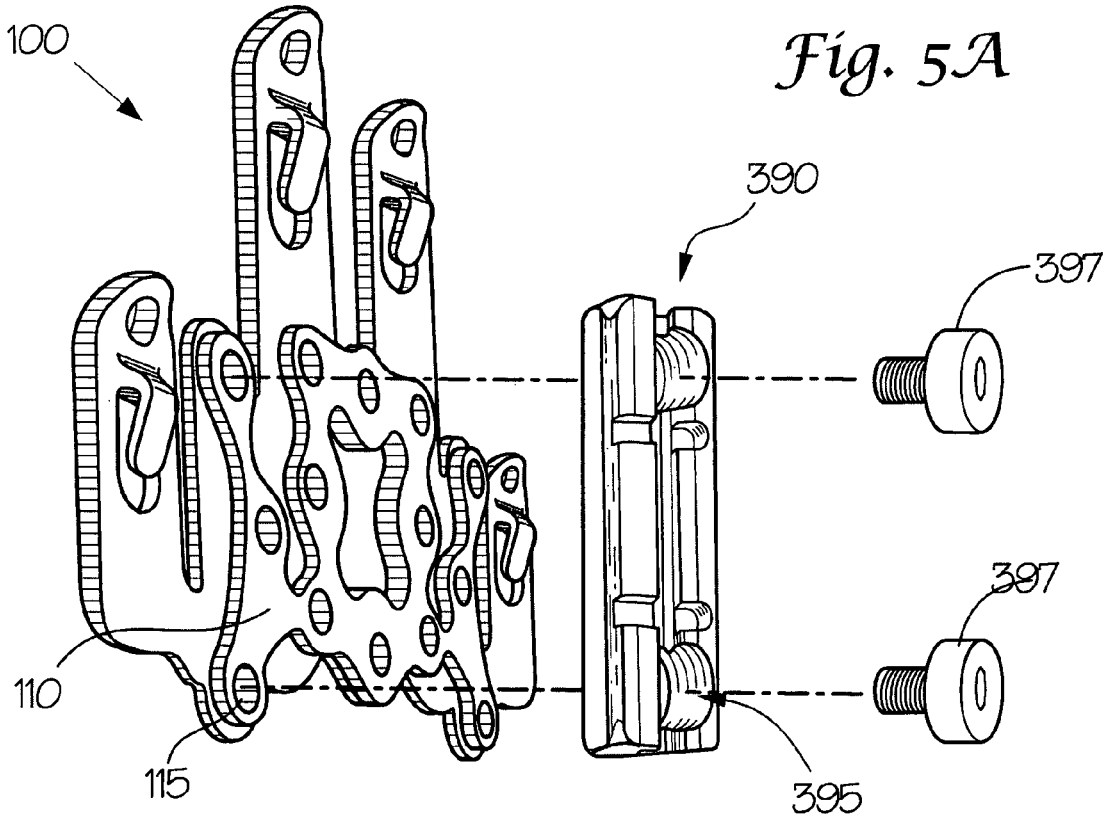
FIG. 5A shows a perspective view of a first exemplary embodiment of the mounting platform, wherein an exemplary accessory rail is shown in exploded view to illustrate exemplary placement of an accessory rail if attached to the platform according to this invention.

FIG. 5A shows a perspective view of the first exemplary embodiment of the mounting platform 100, wherein an exemplary accessory rail 390 is shown in exploded view to illustrate exemplary placement of an accessory rail if attached to the platform according to this invention.

As illustrated in FIG. 5A, the accessory rail 390 is attached to the accessory attachment portion 110, via two fastening means 397, such as, for example, screws, being placed through two of the attachment points 115. It should be appreciated that the two fastening means 397 may either engage a threaded portion of the attachment points 115 or a nut (not shown) located on the opposite side of the mounting platform 100. Additionally, while FIG. 5A illustrates the accessory rail 390 being attached to the accessory attachment portion 110 via two fastening means 397, the accessory rail 390 (or any accessory) can, in various exemplary embodiments, be attached to the platform 110 via, any number or type of known or later developed single or compound fastener. For example, an accessory may be attached to the platform 110 via one screw or fastener, a plurality of screws or fasteners, one or more pins, a combination of one or more pins and one or more screws, mating surfaces that allow for secure attachment while allowing for orientation at any angle, a "tongue and groove", or step-and-slot type fastening means, or any other known or later developed means or method for attaching or coupling an accessory to the mounting platform 100.

It should also be appreciated that by aligning the two attachment points 395 of the accessory rail 390 with various attachment points 115, the accessory rail 390 may be attached or coupled to the mounting platform 100 at various angles relative to the mounting platform 100.

Figure 5B:
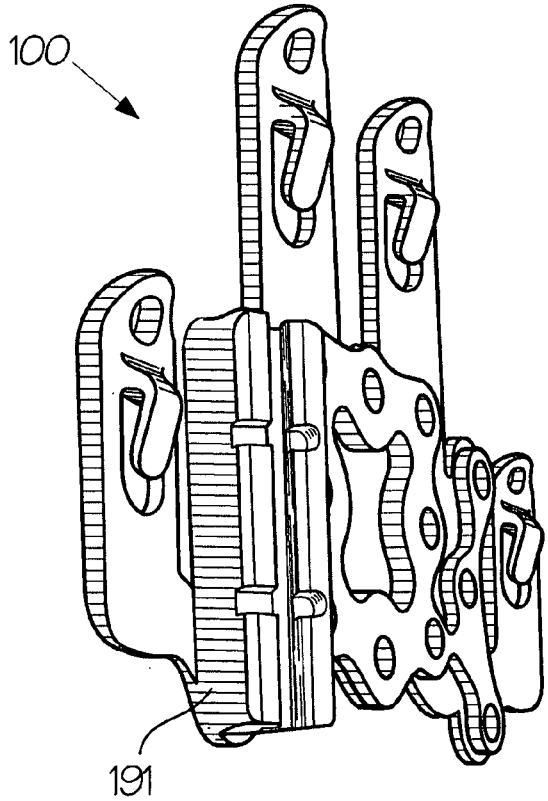
FIG. 5B shows a perspective view of a first exemplary embodiment of the mounting platform, wherein an exemplary accessory rail is shown as being integrally formed as part of the platform according to this invention.

FIG. 5B shows a perspective view of a first exemplary embodiment of the mounting platform 100, wherein an exemplary accessory rail 391 is shown as being integrally formed as part of the platform 100 according to this invention. It should be understood is that various accessories may be formed as an integral part of the mounting platform of this invention. Any integrally formed accessories may occupy the entire accessory attachment portion of the mounting platform or may only occupy a portion of the accessory attachment portion.

Figure 6:
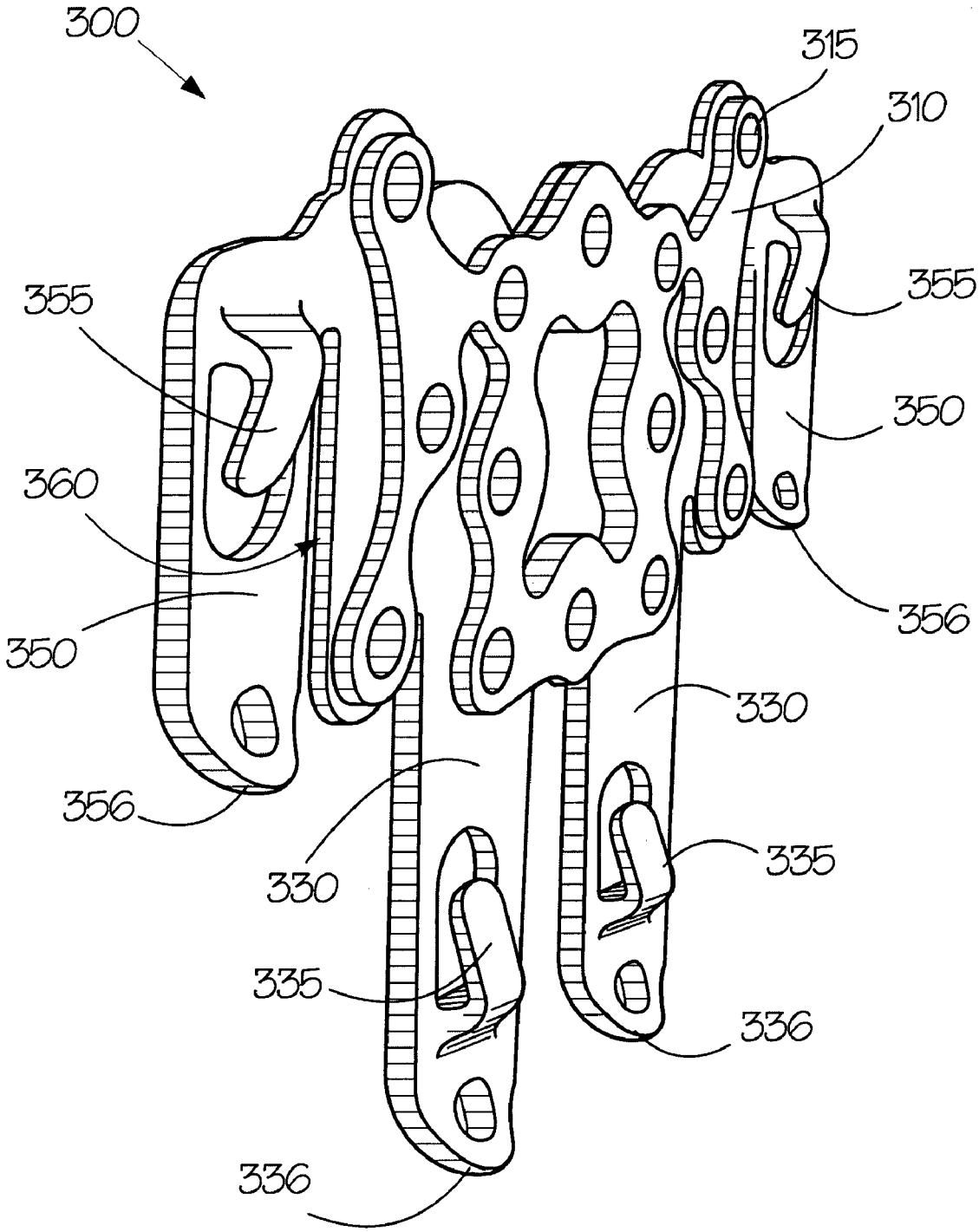
FIG. 6 shows a perspective view of a third exemplary embodiment of a mounting platform according to this invention.

FIG. 6 shows a perspective view of a third exemplary embodiment of a mounting platform according to this invention. As illustrated in FIG. 6, the mounting platform 300 comprises at least some of a plurality of attachment points 315 defining an accessory attachment portion 310, two primary coupling portions 330, each including a hook 335 and extending from the accessory attachment portion 310, two secondary coupling portion 350, each including a hook 355 and extending from the accessory attachment portion 310, and the grooves 360.

It should be understood that each of these elements corresponds to and operates similarly to the accessory attachment portion 110, the plurality of attachment points 115, primary coupling portion(s) 130, the hook(s) 135, the secondary coupling portion(s) 150, the hook(s) 155, and the grooves 160, as described above with reference to the mounting platform 100 of FIGS. 1-4B.

However, as shown in FIGS. 1-4B, the mounting platform 100 is oriented such that the primary coupling portion(s) 130 and the secondary coupling portion(s) 150 extend upward from the accessory attachment portion 110. In contrast, in FIG. 6, the primary coupling portion(s) 330 and the secondary coupling portion(s) 350 extend downward from the accessory attachment portion 310. It should be appreciated that the orientation of each of the primary coupling portions 130 and 330 and the secondary coupling portions 150 and 350, is a design choice based on the desired appearance, strength, functionality, and compatibility of the mounting platform.

Figure 7A:
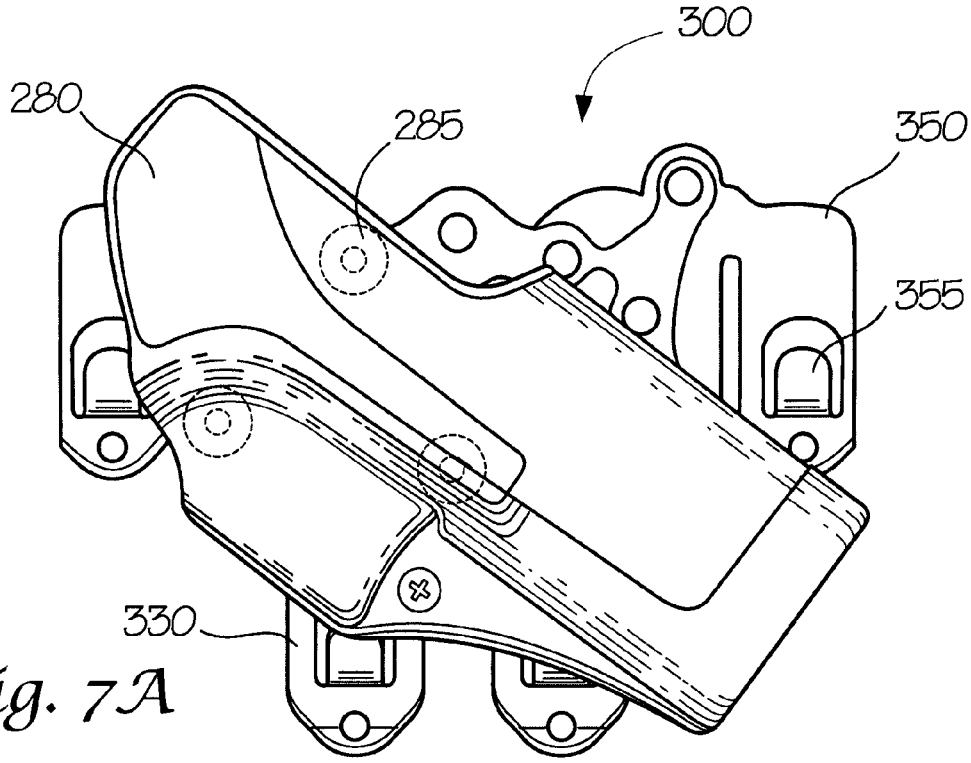
FIG. 7A shows a front view of a fourth exemplary embodiment of the mounting platform, wherein an exemplary holster is attached to the platform according to this invention.
Figure 7B:
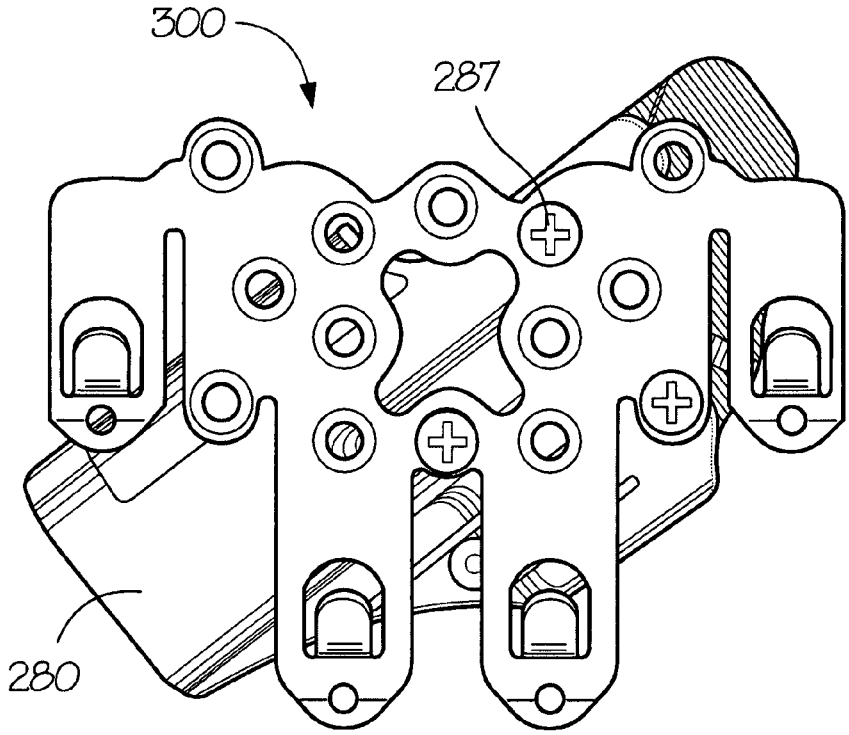
FIG. 7B shows a rear view of a fourth exemplary embodiment of the mounting platform, wherein an exemplary holster is attached to the platform according to this invention.

FIGS. 7A and 7B show a front view and a rear view, respectively, of the mounting platform 300, wherein an exemplary holster 280 is attached to the mounting platform 300, according to this invention. As illustrated in FIGS. 7A and 7B, the holster 280 is attached to the accessory attachment portion 310, via three fastening means 287, such as, for example, screws, being placed through three of the attachment points 315 and engaging three attachment points 285 of the holster 280. It should be appreciated that by aligning the three attachment points 285 of the holster 280 with various attachment points 315, the holster 280 may be attached or coupled to the mounting platform 300 at various angles relative to the mounting platform 300.

While this invention has been described in conjunction with the exemplary embodiments outlined above, it is evident that many alternatives, modifications, and variations will be apparent to those skilled in the art. Such adaptations and modifications should and are intended to be comprehended within the meaning and range of equivalents of the disclosed exemplary embodiments. It is to be understood that the phraseology of terminology employed herein is for the purpose of description and not of limitation. Accordingly, the foregoing description of the exemplary embodiments of the invention, as set forth above, are intended to be illustrative, not limiting. Various changes, modifications, and/or adaptations may be made without departing from the spirit and scope of this invention.

What is claimed is:

1. A mounting platform for removable attachment between tunnel segments of parallel webbing, comprising:

at least one accessory attachment portion;

at least one primary coupling portion extending from the at least one accessory attachment portion, wherein each primary coupling portion is formed so as to allow each primary coupling portion to extend into a tunnel segment formed in the parallel webbing;

a hook extending from a portion of the primary coupling portion;

at least two secondary coupling portions, wherein each secondary coupling portion extends from a different side portion of the at least one accessory attachment portion, wherein each secondary coupling portion is formed so as to allow each secondary coupling portion to extend into a tunnel segment formed in the parallel webbing; and wherein each secondary coupling portion includes a hook extending from a portion of each secondary coupling portion, wherein the hook allows the secondary coupling portion of the secondary coupling portion to be removably secured to a portion of webbing when the secondary coupling portion has been positioned within a tunnel segment of the parallel webbing.

2. The mounting platform of claim 1, wherein the mounting platform comprises two primary coupling portions.

3. The mounting platform of claim 2, wherein the two primary coupling portions are substantially parallel.

4. The mounting platform of claim 1, wherein the accessory attachment portion is substantially planar.

5. The mounting platform of claim 1, wherein the mounting platform comprises two secondary coupling portions.

6. The mounting platform of claim 1, wherein the mounting platform is formed of a rigid material.

7. The mounting platform of claim 1, wherein the mounting platform is formed of a semi-rigid material.

8. The mounting platform of claim 1, wherein the accessory attachment portion includes a plurality of attachment points.

9. The mounting platform of claim 8, wherein the spacing and arrangement of the attachment points allows at least one accessory to be mounted to the mounting platform.

10. The mounting platform of claim 8, wherein the attachment points comprise a plurality of holes formed through the accessory attachment portion.

11. The mounting platform of claim 8, wherein the attachment points comprise a plurality of apertures formed in the accessory attachment portion.

12. The mounting platform of claim 11, wherein the attachment points comprise a plurality of protrusions that each extend from the accessory attachment portion.

13. The mounting platform of claim 11, wherein the attachment points comprise a plurality of threaded portions.

14. The mounting platform of claim 1, wherein the accessory attachment portion is formed so as to allow a user to attach, form, or create attachment points on the accessory attachment portion.

15. The mounting platform of claim 1, wherein a terminal portion of the primary coupling portion(s) and/or the secondary coupling portion(s) comprises a curved portion.

16. The mounting platform of claim 1, wherein the primary coupling portion(s) extend upward from the accessory attachment portion and the secondary coupling portion(s) extend downward from the accessory attachment portion.

17. The mounting platform of claim 1, wherein the primary coupling portion(s) extend downward from the accessory attachment portion and the secondary coupling portion(s) extend upward from the accessory attachment portion.

18. The mounting platform of claim 1, wherein the primary coupling portion(s) extend downward from the accessory attachment portion and the secondary coupling portion(s) extend downward from the accessory attachment portion.

19. The mounting platform of claim 1, wherein the primary coupling portion(s) extend upward from the accessory attachment portion and the secondary coupling portion(s) extend upward from the accessory attachment portion.

20. The mounting platform of claim 1, wherein an accessory formed as an integral part of the accessory attachment portion.

21. A mounting platform for removable attachment between tunnel segments of parallel webbing, comprising:

at least one accessory attachment portion, wherein the accessory attachment portion includes a plurality of spaced apart holes formed therethrough;

at least one, elongate primary coupling portion extending from the at least one accessory attachment portion, wherein each primary coupling portion is formed so as to allow each primary coupling portion to extend into a tunnel segment formed in the parallel webbing;

wherein each primary coupling portion includes a hook extending from a portion of the primary coupling portion, wherein the hook allows the primary coupling portion of the primary coupling portion to be removably secured to a portion of webbing when the primary coupling portion has been positioned within a tunnel segment of the parallel webbing; wherein the fastening means are capable of extending through the spaced apart holes to engage points of attachment defined on a holster or an accessory carrier; and wherein a relative angle of the holster or accessory carrier to the accessory attachment portion is adjustable by alignment of the spaced apart holes with the points of attachment defined on the holster or the accessory carrier.

22. The mounting platform of claim 21, further including at least one, elongate secondary coupling portion extending proximate a side portion of the accessory attachment portion, wherein each secondary coupling portion is formed so as to allow each secondary coupling portion to extend into a tunnel segment formed in the parallel webbing; and a hook extending from a portion of the secondary coupling portion, wherein the hook allows the secondary coupling portion of the secondary coupling portion to be removably secured to a portion of webbing when the secondary coupling portion has been positioned within a tunnel segment of the parallel webbing.

23. A mounting platform, comprising:

at least one accessory attachment portion;

at least one primary coupling portion extending from the at least one accessory attachment portion;

wherein each primary coupling portion includes a hook extending from a portion of the primary coupling portion;

at least two secondary coupling portions, wherein each secondary coupling portion extends from a different side portion of the at least one accessory attachment portion; and wherein each secondary coupling portion includes a hook extending from a portion of each secondary coupling portion.

* * * * *